US008100136B1

(12) United States Patent
Mason

(10) Patent No.: US 8,100,136 B1
(45) Date of Patent: Jan. 24, 2012

(54) HAIR CURLING KIT

(76) Inventor: Stephon Mason, Hattiesburg, MS (US)

( * ) Notice: Subject to any disclaimer, the term of this patent is extended or adjusted under 35 U.S.C. 154(b) by 424 days.

(21) Appl. No.: 12/274,198

(22) Filed: Nov. 19, 2008

(51) Int. Cl.
*A45D 7/00* (2006.01)
*A45D 2/00* (2006.01)

(52) U.S. Cl. ..... 132/223; 132/200

(58) Field of Classification Search ..... 132/219, 132/107, 126, 139, 141, 142, 144, 145, 148, 132/150, 159, 161, 223, 245–260, 200
See application file for complete search history.

(56) References Cited

U.S. PATENT DOCUMENTS

| | | | | |
|---|---|---|---|---|
| 564,460 | A * | 7/1896 | Traun | 132/143 |
| 1,442,757 | A * | 1/1923 | White | 132/117 |
| 2,027,121 | A * | 1/1936 | Ross | 132/157 |
| 2,126,253 | A * | 8/1938 | Goldberg | 132/223 |
| 2,506,297 | A | 6/1947 | Goodman | |
| 2,534,649 | A * | 12/1950 | Witschi | 132/122 |
| 2,598,330 | A * | 5/1952 | Wilson | 132/117 |
| 2,613,679 | A * | 10/1952 | Vaughn | 132/122 |
| 2,814,302 | A * | 11/1957 | Nash | 132/101 |
| 3,939,852 | A | 2/1976 | Waite et al. | |
| 4,031,907 | A | 6/1977 | Rogers | |
| 4,286,608 | A * | 9/1981 | Handley et al. | 132/245 |
| 4,359,061 | A | 11/1982 | Colclasure | |
| 4,984,590 | A | 1/1991 | Bachtell | |
| 5,284,167 | A * | 2/1994 | Gill | 132/200 |
| 5,791,354 | A | 8/1998 | Maznik | |
| 5,927,291 | A | 7/1999 | Beall | |
| 6,189,540 | B1 | 2/2001 | Stovall et al. | |
| 6,286,519 | B1 | 9/2001 | Stachowski | |
| D479,625 | S | 9/2003 | Poliseno | |
| 7,231,925 | B1 * | 6/2007 | Wall | 132/149 |
| 7,640,893 | B2 * | 1/2010 | Woods | 119/613 |
| 2003/0037794 | A1 | 2/2003 | Shannon | |
| 2004/0168697 | A1 * | 9/2004 | Brown | 132/139 |
| 2007/0119474 | A1 | 5/2007 | Strassmayer | |

FOREIGN PATENT DOCUMENTS

GB 2122079 A * 1/1984

* cited by examiner

*Primary Examiner* — Robyn Doan
(74) *Attorney, Agent, or Firm* — Kenneth M. Bush; Bush Intellectual Property Law

(57) ABSTRACT

The hair curling kit of the present invention preferably comprises a first parting device, a second parting device, and respective first, second, and third types of conventional hair rollers to facilitate the curling of hair for a myriad of hairstyles. The parting devices are designed to uniformly and quickly part a section of hair that corresponds to a respective type of hair roller included in the hair curling kit. The parting of hair is accomplished with a single passage of the parting device along the roots of the hair and scalp without requiring a second parting that is customary with conventional combs. The segregated hair is engaged to conventional hair rollers included with the hair curling kit in order to curl hair for a myriad of hairstyles. The parting devices can alternatively include integral elements that facilitate the combing and/or picking of hair with a single implement.

2 Claims, 4 Drawing Sheets

HAIR CURLING KIT

BACKGROUND OF THE INVENTION

1. Field of the Invention

The present invention relates to hair curling kits and more particularly, to a hair curling kit that allows a user to quickly and efficiently part a section of hair for subsequent engagement to a conventional hair roller in order to curl hair for a myriad of hairstyles.

2. Description of the Related Art

Many hairstyles require all or a portion of a person's hair to be curled in order to create the hairstyle. Curling hair can be done in a number of ways, but one of the most common involves using a comb to part the hair and then rolling the segregated portion of hair onto a hair roller. In order to part hair with a conventional comb, a person usually collects a portion of hair in one hand and subsequently parts an area of hair at the roots on one side—typically with the end tine of a comb. Depending on where the hair is, this step is usually repeated for at least one other side to segregate the collection of hair at the root from surrounding hairs. This can be quite time-consuming and tedious for people with long or short hair. Moreover, a person just normally "eyeballs" where to make the subsequent parts or just feels where to make the part. This does not lend itself to uniformity, which may ultimately affect the hairstyle desired.

Compounding the frustration associated with rolling hair is having the correct hair rollers to accommodate different lengths and textures of hair for different hairstyles. For instance, a person who wants tight curls has no use for larger hair rollers. The types and sizes of hair rollers cover a vast spectrum. Hence, a person is usually forced to purchase a plurality of sets of hair rollers in order to accommodate a myriad of hairstyles.

There is much prior art covering devices used in the curling of hair. Combs and hair rollers are well known in their respective arts. However, the prior art is silent with regards to a kit having cooperating devices designed to facilitate the parting and curling of hair for different hairstyles. The hair curling kit of the instant invention solves the problem by having a plurality of parting devices that correspond to different types of hair rollers, which allows a user to uniformly and quickly part a section of hair to be rolled on one of the included hair rollers.

SUMMARY OF THE INVENTION

The hair curling kit of the present invention preferably comprises respective first and second parting devices and respective first, second, and third types of hair rollers. The parting devices are designed to uniformly and quickly part a section of hair that corresponds to a respective type of hair roller.

In the preferred embodiment, the parting devices feature a rigid body having a generally U-shaped configuration that is substantially planar. The parting devices have an elongated generally rectangular spine from which a first elongated tooth and a second elongated tooth longitudinally and integrally extend from the respective ends of a sidewall of the spine in a parallel manner. The ends of the opposing sidewall of the spine are rounded to allow a user to comfortably grasp the parting device when the parting device is in use. The elongated teeth project and taper to an end point that is distal from the spine. The respective end points of the elongated teeth are crowned with generally bulbous tips. These bulbous tips facilitate parting the hair on two sides with minimal irritation to the scalp of a person and without requiring at least a second parting that is customary with conventional combs.

The hair curling kit of the present invention preferably comprises at least two parting devices of varying dimensions with respect to the length of the elongated teeth and the distance there between. This difference in dimensions between the parting devices is necessary to facilitate use with conventional hair rollers of various lengths and circumferences that are included in the hair curling kit.

A second embodiment of the parting device teaches the integral inclusion of a plurality of spaced apart comb teeth that afford the user the dual functionality of combing or quickly parting hair with a single implement. Alternatively, the hair curling kit can separately include a comb and the parting devices if a user prefers this arrangement.

A third embodiment of the parting device teaches the integral inclusion of a plurality of spaced apart comb teeth and a pick member that afford the user the increased functionality of combing, picking, and/or quickly parting hair with a single implement.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is a hair curling kit and is generally designated by the reference number 10. The hair curling kit preferably comprises a plurality of parting devices and a plurality of hair rollers designed to facilitate the curling of hair for a myriad of hairstyles.

Figure 1:
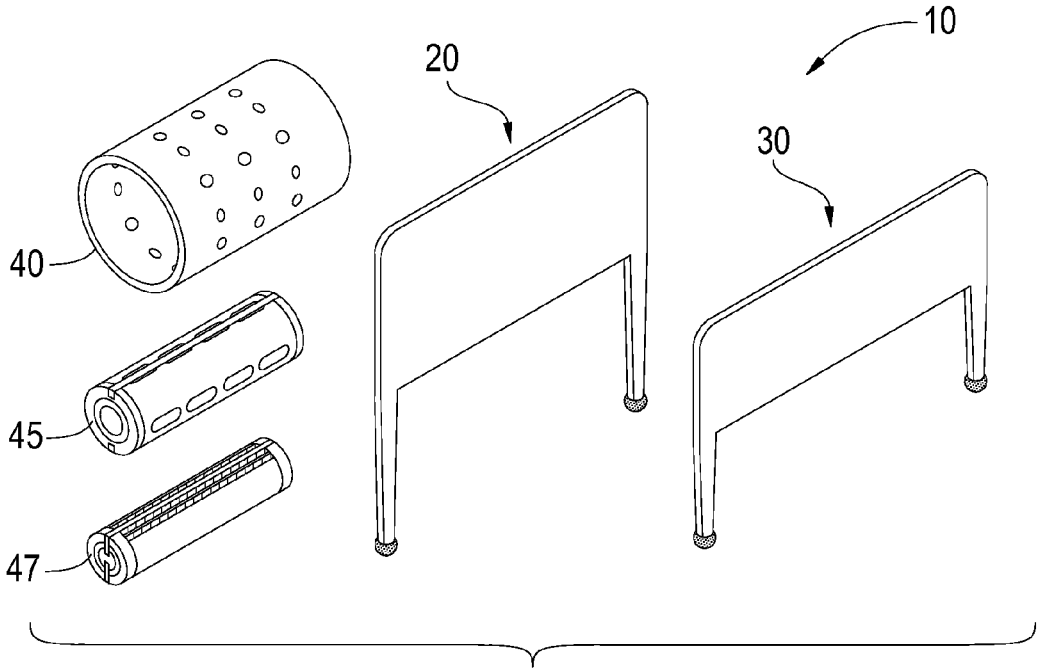
FIG. 1 is a perspective view of the hair curling kit according to the present invention.

As seen in FIG. 1, the hair curling kit 10 includes at least two parting devices 20,30 and at least three types of hair rollers 40,45,47. The parting devices 20,30 have different dimensions to work in conjunction with the corresponding hair rollers 40,45,47 that have different dimensions, features, and functions.

Figure 2:
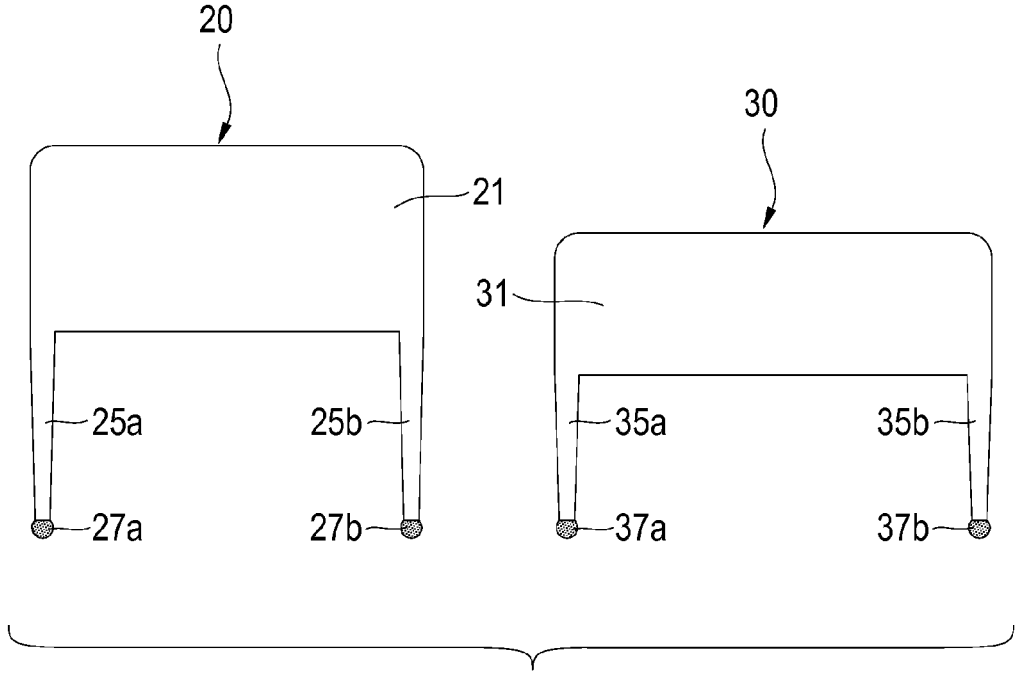
FIG. 2 is a plan view of the parting devices in the hair curling kit according to the present invention.

As seen in FIGS. 1-2, a first parting device 20 of the hair curling kit 10 is a rigid construction having a generally U-shaped configuration that is substantially planar. The parting device 20 has an elongated generally rectangular spine 21 from which a first elongated tooth 25*a* and a second elongated tooth 25*b* longitudinally and integrally extend from the respective ends of a sidewall of the spine 21 in a parallel manner. The ends of the opposing sidewall of the spine 21 are rounded to allow a user to comfortably grasp the parting device 20 when the parting device 20 is in use. The elongated teeth 25*a*,25*b* project and taper to an end point that is distal from the spine 21. The respective end points of the elongated teeth 25*a*,25*b* are crowned with generally bulbous tips 27*a*, 27*b*. These bulbous tips 27*a*,27*b* facilitate parting the hair with minimal irritation to the scalp of a person.

Also seen in FIGS. 1-2, a second parting device 30 of the hair curling kit 10 is a rigid construction having a generally U-shaped configuration that is substantially planar. The parting device 30 has an elongated generally rectangular spine 31 from which a first elongated tooth 35*a* and a second elongated tooth 35*b* longitudinally and integrally extend from the respective ends of a sidewall of the spine 31 in a parallel manner. The ends of the opposing sidewall of the spine 31 are rounded to allow a user to comfortably grasp the parting device 30 when the parting device 30 is in use. The elongated teeth 35*a*,35*b* project and taper to an end point that is distal from the spine 31. The respective end points of the elongated teeth 35*a*,35*b* are crowned with generally bulbous tips 37*a*, 37*b*. These bulbous tips 37*a*,37*b* facilitate parting the hair with minimal irritation to the scalp of a person.

Referring to FIG. 2, in comparison, the teeth 35*a*,35*b* of the second parting device 30 are shorter in length than the teeth 25*a*,25*b* of the first parting device 20, but the distance between tooth 35*a* and tooth 35*b* of the second parting device 30 is greater than the distance between tooth 25*a* and tooth 25*b* of the first parting device 20. This difference in dimensions between the parting devices 20,30 is necessary to facilitate use with conventional hair rollers 40,45,47 of various lengths and circumferences that are included in the hair curling kit 10.

In the preferred embodiment, the spines 21,31 and the teeth 25*a*,25*b*,35*a*,35*b* of the parting devices 20,30 of the hair curling kit 10 are molded from a suitable relatively rigid resin material having limited flexibility, including, but not limited to, an acetal polymer or nylon, for example. The spines 21,31 and the teeth 25*a*,25*b*,35*a*,35*b* of the parting devices 20,30 can be made from other synthetic or suitable materials that offer similar degree of inflexibility. Suitable integrally molded indicia, such as the name of a company or hair salon, may be formed on at least one surface of the spines 21,31. The bulbous tips 27*a*,27*b*,37*a*,37*b* of the teeth 25*a*,25*b*,35*a*,35*b* of the parting devices 20,30 are ideally made from metal, including, but not limited to, stainless steel.

Figure 3:
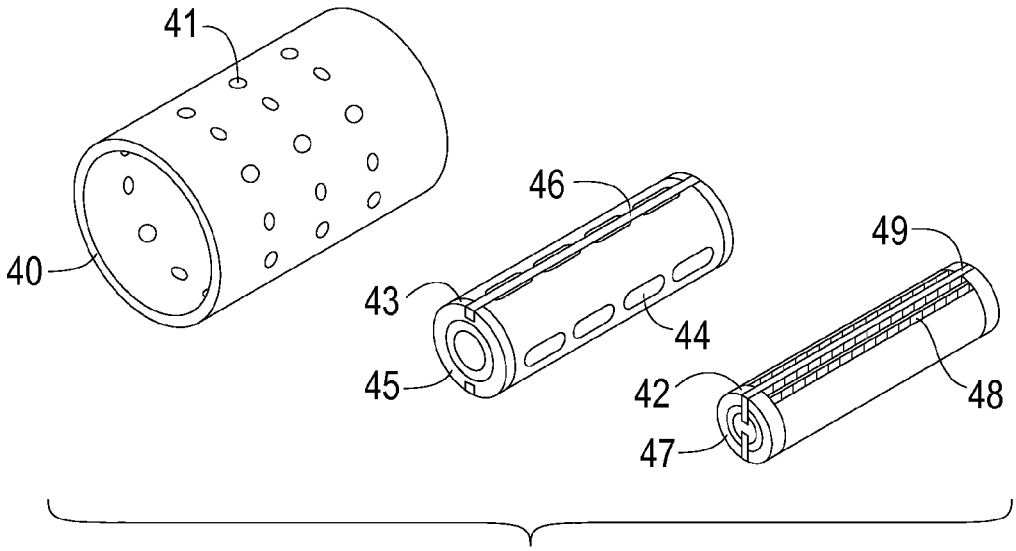
FIG. 3 is a perspective view of the hair rollers in the hair curling kit according to the present invention.

As seen in FIGS. 1 and 3, the hair curling kit 10 includes a plurality of conventional hair rollers 40,45,47. It is within the scope of the present invention to include a plurality of different types of hair rollers within the hair curling kit 10 in order to accommodate a myriad of hairstyles. The hair curling kit 10 includes a plurality of each type of hair roller 40,45,47, thereby permitting a user to curl an entire head of hair or a portion thereof. A first type of hair roller 40 in the hair curling kit 10 is defined by an elongated hollow barrel having a plurality of serial apertures 41 in the sidewall in a spaced apart arrangement. The elongated hollow barrel of the hair roller 40 is open-ended. A second type of hair roller 45 in the hair curling kit 10 is defined by an elongated hollow barrel where one end of the barrel is permanently enclosed with a sidewall and the opposing end is selectively enclosed by a cap member 43 that is tethered to the permanent sidewall by an elastic elongate 46. The elongated hollow barrel of the second type of hair roller 45 includes a plurality of serial apertures 44 in the sidewall in a spaced apart arrangement. A third type of hair roller 47 in the hair curling kit 10 is defined by a elongated barrel where one end of the barrel is permanently enclosed with a sidewall and the opposing end is selectively enclosed by a cap member 42 that is tethered to the permanent sidewall by an elastic elongate 49. The elongated hollow barrel of the third type of hair roller 47 includes a plurality of spaced apart slits 48 that generally span the length of the hair roller 47.

The different dimensions and arrangements of the hair rollers 40,45,47 afford a user a greater range of achievable hairstyles. For instance, hair roller 40 is typically used to create larger curls, while hair roller 47 is typically used for tighter curls when a user perms his or her hair.

In use, a user must determine which type of hair roller 40,45,47 is appropriate based on the style desired and the length and thickness of a person's hair. Once the hair roller is selected, the user selects the appropriate parting device 20,30 that corresponds to the size of the hair roller 40,45,47 that will be used. For instance, parting device 20 is designed for use in conjunction with hair roller 40. With the bulbous metal tips 27*a*,27*b* engaging the scalp, a user forcibly urges the parting device 20 along the scalp, which quickly parts the hair on two sides at the root at once with minimal irritation to the scalp and without requiring at least a second parting that is customary with conventional combs. The segregated section of hair is then manipulated with hair roller 40 that is secured thereto with conventional means. This process is repeated until all the targeted areas of hair are parted and subsequently curled.

Figure 4:
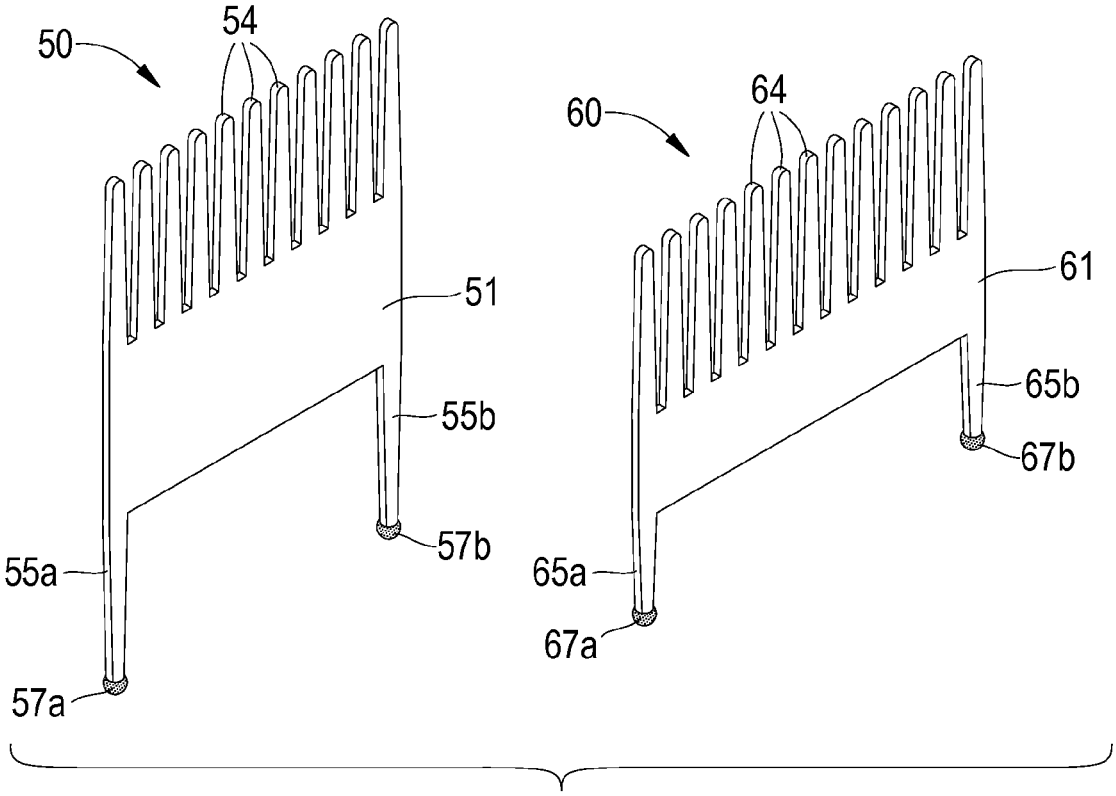
FIG. 4 is a perspective view of the first alternative embodiments of the parting devices in the hair curling kit according to the present invention.

Referring to FIG. 4, alternative embodiments of the devices used for parting hair are taught. A first alternative embodiment 50 of the parting device of the hair curling kit 10 discloses the addition of comb teeth 54 that afford the user the convenience of being able to comb and quickly part hair with a single implement. The parting device 50 is a rigid construction that is substantially planar. The parting device 50 has an elongated generally rectangular central body 51 from which a first elongated tooth 55*a* and a second elongated tooth 55*b* longitudinally and integrally extend from the respective ends of a sidewall of the spine 51 in a parallel manner. The elongated teeth 55*a*,55*b* project and taper to an end point that is distal from the central body 51. The respective end points of the elongated teeth 55*a*,55*b* are crowned with generally bulbous tips 57*a*,57*b*. These bulbous tips 57*a*,57*b* facilitate parting the hair with minimal irritation to the scalp of a person. The opposing sidewall of the central body 51 has a plurality of spaced apart comb teeth 54 that longitudinally and integrally extend from the sidewall and span the length thereof. These teeth 54 allow a user to comb hair in a conventional manner without having to procure a separate combing implement. Therefore, the first alternative embodiment 50 of the parting device has dual functionality as a combing device and parting device.

Also seen in FIG. 4, another version 60 of the first alternative embodiment of the parting device of the hair curling kit 10 is a rigid construction that is substantially planar. The parting device 60 has an elongated generally rectangular central body 61 from which a first elongated tooth 65*a* and a second elongated tooth 65*b* longitudinally and integrally extend from the respective ends of a sidewall of the spine 61 in a parallel manner. The elongated teeth 65*a*,65*b* project and taper to an end point that is distal from the central body 61. The respective end points of the elongated teeth 65*a*,65*b* are crowned with generally bulbous tips 67*a*,67*b*. These bulbous tips 67*a*,67*b* facilitate parting the hair with minimal irritation to the scalp of a person. The opposing sidewall of the central body 61 has a plurality of spaced apart comb teeth 64 that longitudinally and integrally extend from the sidewall and span the length thereof. These teeth 64 allow a user to comb hair in a conventional manner without having to procure a separate combing implement. Therefore, the parting device 60 has dual functionality as a combing device and a parting device.

Referring again to FIG. 4, in comparison, the teeth 65*a*,65*b* of the parting device 60 are shorter in length than the teeth 55*a*,55*b* of parting device 50, but the distance between tooth 65*a* and tooth 65*b* of parting device 60 is greater than the distance between tooth 55*a* and tooth 55*b* of parting device 50. This difference in dimensions between the parting devices 50,60 is necessary to facilitate use with conventional hair rollers 40,45,47 of various lengths and circumferences that are included in the hair curling kit 10.

Figure 5:
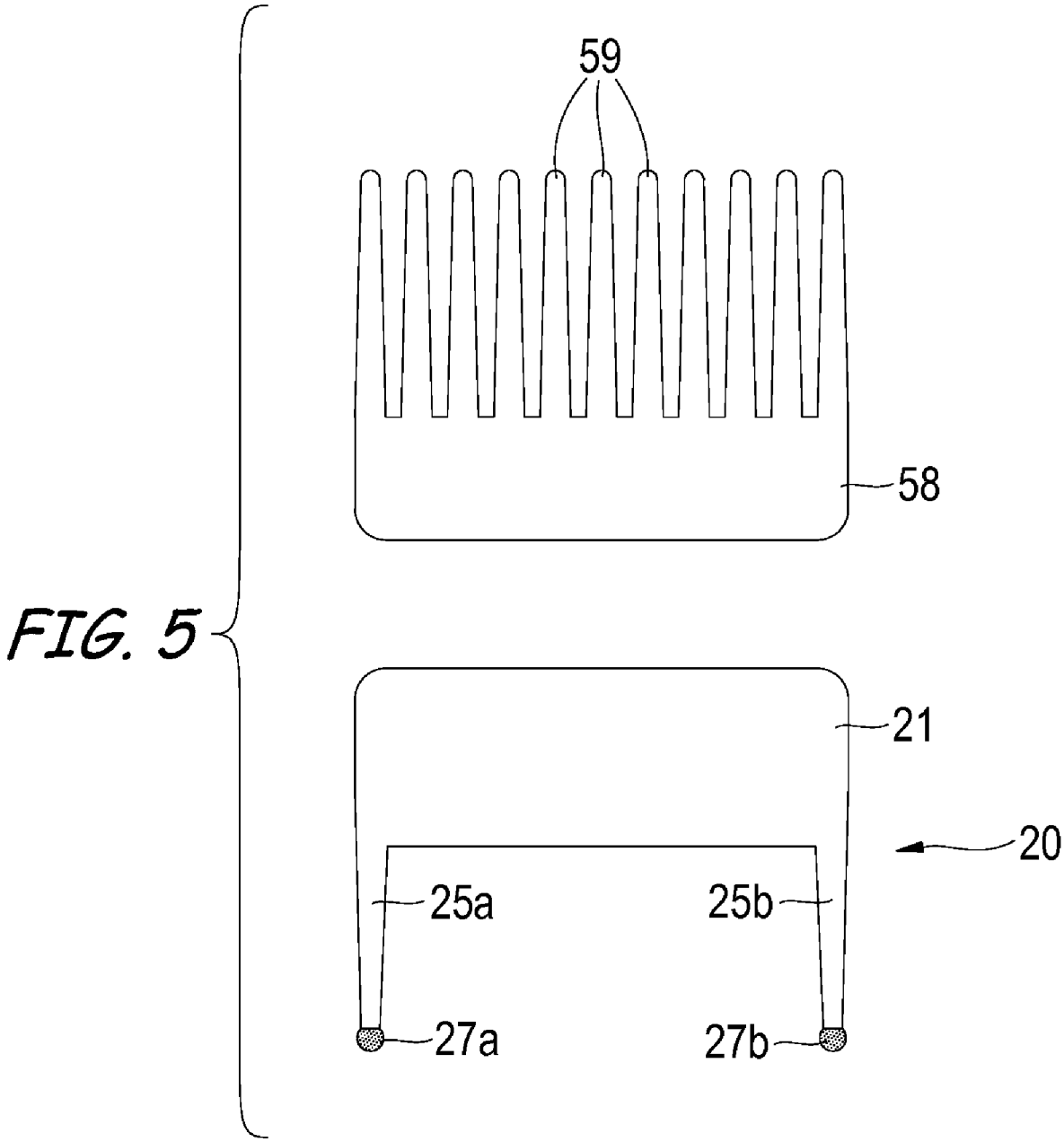
FIG. 5 is a plan view of a comb and a parting device in the hair curling kit according to the present invention.

Alternatively, as seen in FIG. 5, instead of parting devices 50,60 that have dual functionality as combing devices and parting devices, the hair curling kit 10 may include separate devices for combing hair, such as the comb 5*g* having a plurality of spaced apart comb teeth 59 that longitudinally and integrally extend from a sidewall and span the length thereof, in conjunction with the parting devices 20,30 in the preferred embodiment.

Figure 6:
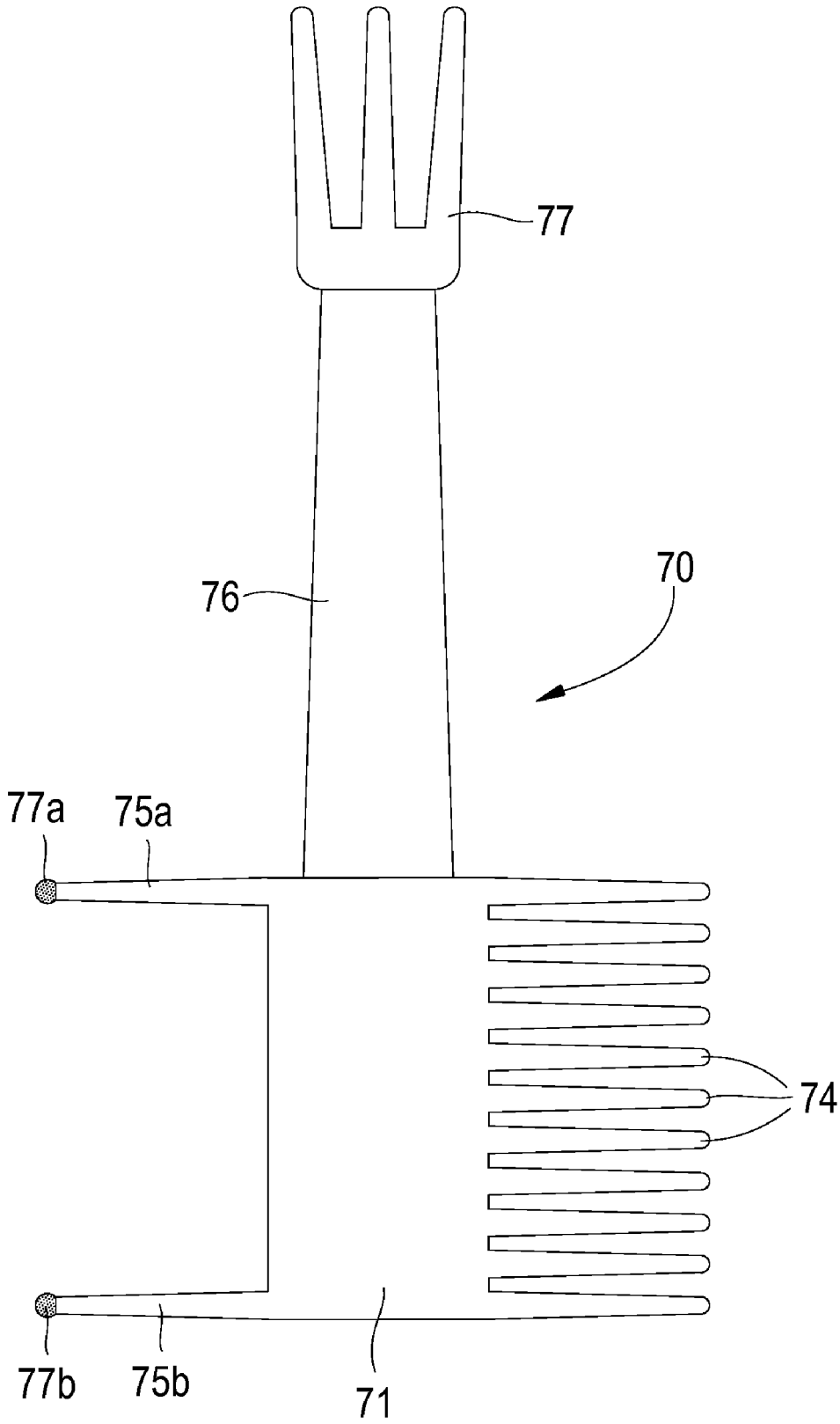
FIG. 6 is a plan view of a second alternative embodiment of a parting device in the hair curling kit according to the present invention.

Referring to FIG. 6, a second alternative embodiment 70 of the parting device of the hair curling kit 10 discloses the addition of comb teeth 74 and a pick member 77 that afford the user the convenience of being able to comb, pick, or quickly part hair with a single implement. The parting device 70 is a rigid construction having a generally T-shaped configuration that is substantially planar. The parting device 70 has an elongated generally rectangular central body 71 from which a first elongated tooth 75*a* and a second elongated tooth 75*b* longitudinally and integrally extend from the respective ends of a sidewall of the spine 71 in a parallel manner. The elongated teeth 75*a*,75*b* project and taper to an end point that is distal from the central body 71. The respective end points of the elongated teeth 75*a*,75*b* are crowned with generally bulbous tips 77*a*,77*b*. These bulbous tips 77*a*,77*b* facilitate parting the hair with minimal irritation to the scalp of a person. The opposing sidewall of the central body 71 has a plurality of spaced apart comb teeth 74 that longitudinally and integrally extend from the sidewall and span the length thereof. These teeth 74 allow a user to comb hair in a conventional manner without having to procure a separate combing implement. In addition, the second alternative embodiment of the parting device 70 has a pick handle 76 that extends perpendicularly with respect to the elongate teeth 74,77*a*,77*b* from a third sidewall of the central body 71. The pick handle 76 tapers toward a distal end that supports a pick member 77 having a plurality of pick tines that facilitate the picking of hair. Therefore, the second alternative embodiment 70 of the parting device has increased functionality as a combing device, a picking device, and a parting device. The dimensions of parting device 70 can be adjusted to accommodate use with hair rollers of different sizes. Therefore, a hair curling kit 10 may include at least two parting devices 70 of diverse dimensions.

The foregoing description has been limited to specific embodiments of this invention. It will be apparent, however, that variations and modifications may be made by those skilled in the art to the disclosed embodiments of the invention, with the attainment of some or all of its advantages and without departing from the spirit and scope of the present invention. For example, a greater number of different types of hair rollers may be included in the hair curling kit 10, which then may increase the number of different parting devices included therein. Additional embodiments of the present invention include a carrying case designed for storing and transporting the hair curling kit 10. The carrying case may feature specific compartments and/or recesses designed to uniquely accommodate particular components of the hair curling kit 10 and general compartments and/or recesses designed to hold additional styling equipment or supplies. Moreover, the preferred embodiment of the parting devices 20,30 can be adapted to include substantially shorter teeth that are spaced apart equally between the elongated teeth 25*a*,25*b*,35*a*,35*b*. These shorter teeth would engage and comb hair as the parting devices 20,30 part the targeted hair. Other types of hair curling equipment may be included in the hair curling kit 10.

It will be understood that various changes in the details, materials, and arrangements of the parts which have been described and illustrated above in order to explain the nature of this invention may be made by those skilled in the art without departing from the principle and scope of the invention as recited in the following claims.

The invention claimed is:

1. A method of curling the hair of a person, comprising the steps of:

a) using a hair parting device to form two simultaneous hair parts in the hair of the person, wherein the two hair parts are parallel to each other and spaced apart a predetermined distance, wherein said hair parting device is substantially planar and comprises a substantially rectangular spine having a first sidewall having a first end and an opposing second end, wherein said first sidewall has only two elongated teeth extending therefrom in a coextensive parallel manner for forming the two simultaneous hair parts in the hair of the person, wherein said two elongated teeth include a first tooth extending from said first end of said first sidewall and a second tooth extending from said second end of said first sidewall such that an uninterrupted space is formed between said first tooth and said second tooth for receiving the hair of the person therebetween, and wherein said space formed between said first tooth and said second tooth is commensurate with a width of a hair roller;

b) rolling the hair between the two hair parts onto a hair roller; and c) repeating step a and step b until a predetermined amount of hair has been rolled onto hair rollers.

2. A method according to claim 1, wherein each of said first tooth and said second tooth has a bulbous tip formed on a distal end thereof to facilitate parting the hair of the person with minimal irritation to the scalp of the person.

* * * * *